US007033712B2

(12) United States Patent
Liang et al.

(10) Patent No.: US 7,033,712 B2
(45) Date of Patent: Apr. 25, 2006

(54) METHOD OF MANUFACTURING A COLOR FILTER CATHODE RAY TUBE (CRT)

(75) Inventors: Kangning Liang, Lancaster, PA (US); Bhanumurthy Venkatrama Subrahmanya Gunturi, Lancaster, PA (US)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/354,308

(22) Filed: Jan. 30, 2003

(65) Prior Publication Data

US 2004/0151995 A1 Aug. 5, 2004

(51) Int. Cl.
*H01J 9/20* (2006.01)
*H01J 29/28* (2006.01)

(52) U.S. Cl. ..... 430/27; 427/68; 313/466

(58) Field of Classification Search ..... 430/27; 313/466, 473, 474; 427/68
See application file for complete search history.

(56) References Cited

U.S. PATENT DOCUMENTS 5,476,737 A * 12/1995 Kusunoki et al. ..... 430/23
6,300,022 B1 * 10/2001 Kim et al. ..... 430/27

FOREIGN PATENT DOCUMENTS

| | | | |
|---|---|---|---|
| DE | 1 487 736 | | 12/1966 |
| GB | 1113203 | | 7/1965 |
| JP | 10-308184 A | * | 11/1998 |
| WO | WO 98/54742 | | 12/1998 |

* cited by examiner

*Primary Examiner*—John A. McPherson
(74) *Attorney, Agent, or Firm*—Joseph S. Tripoli; Harvey D. Fried; Richard LaPeruta, Jr.

(57) ABSTRACT

A color filter luminescent screen assembly for a cathode ray tube (CRT) is disclosed. The luminescent screen assembly is formed on an interior surface of a faceplate panel of the CRT tube. The luminescent screen assembly includes a patterned light-absorbing matrix that defines a plurality of sets of fields corresponding to one of a blue region, a red region and a green region. A color filter is formed in one of the plurality of sets of fields. The color filter may be, for example, a blue pigment layer, a red pigment layer or a green pigment layer. After the pigment layer is formed, a cap layer is formed thereon. The cap layer is formed from an aqueous solution of a photosensitive material and a polymer. Thereafter, a phosphor layer is deposited on the cap layer.

16 Claims, 8 Drawing Sheets

METHOD OF MANUFACTURING A COLOR FILTER CATHODE RAY TUBE (CRT)

BACKGROUND OF THE INVENTION

1. Field of the Invention

The invention relates to a color cathode ray tube (CRT) and, more particularly to the manufacturing of a luminescent screen assembly having at least one color filter.

2. Description of the Background Art

A color cathode ray tube (CRT) typically includes an electron gun, an aperture mask, and a screen. The aperture mask is interposed between the electron gun and the screen. The screen is located on an inner surface of a faceplate of the CRT tube. The aperture mask functions to direct electron beams generated in the electron gun toward appropriate color-emitting phosphors on the screen of the CRT tube.

The screen may be a luminescent screen. Luminescent screens typically comprise an array of three different color-emitting phosphors (e.g., green, blue and red) formed thereon. Each of the color-emitting phosphors is separated from another by a matrix line. The matrix lines are typically formed of a light absorbing black, inert material.

In order to enhance the color contrast of the luminescent screen, a pigment layer, or color filter, may be formed between the faceplate panel and the color-emitting phosphor. The color filter typically has a color that corresponds to the color of the color-emitting phosphor formed thereon (e.g., a red-emitting phosphor is formed on a red pigmented filter). The color filter transmits light that is within the emission spectral region of the phosphor formed thereon and absorbs ambient light in other spectral regions, providing a gain in color contrast.

After the application of the color filter, the color-emitting phosphors are typically formed using a subtractive process in which a phosphor layer is deposited on the interior of the faceplate panel, and, in a subsequent development process, select portions of the phosphor layer are removed. Unfortunately, during the phosphor formation process void formation along the edges of the phosphor lines may occur. Void formation is typically caused by a failure of portions of the phosphor coating to adhere properly to the color filter layer during the phosphor formation process. Voids resulting from such adhesion failure may result in lower light output and lower contrast performance for the luminescent screen.

Thus, a need exists for a method of forming a color filter cathode ray tube (CRT) that overcomes the above drawbacks.

SUMMARY OF THE INVENTION

The present invention relates to a color filter luminescent screen assembly for a cathode ray tube (CRT). The luminescent screen assembly is formed on an interior surface of a faceplate panel of the CRT tube. The luminescent screen assembly includes a patterned light-absorbing matrix that defines a plurality of sets of fields corresponding to one of a blue region, a red region and a green region.

A color filter is formed in one of the plurality of sets of fields. The color filter may be, for example, a blue pigment layer, a red pigment layer or a green pigment layer. After the color filter is formed, a cap layer is formed thereon. The cap layer is formed from an aqueous solution of a photosensitive material and a polymer. Thereafter, a phosphor layer is deposited on the cap layer. The cap layer improves the adhesion of the phosphor layer to the color filter. As a result, the luminescent screen is less susceptible to void formation.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
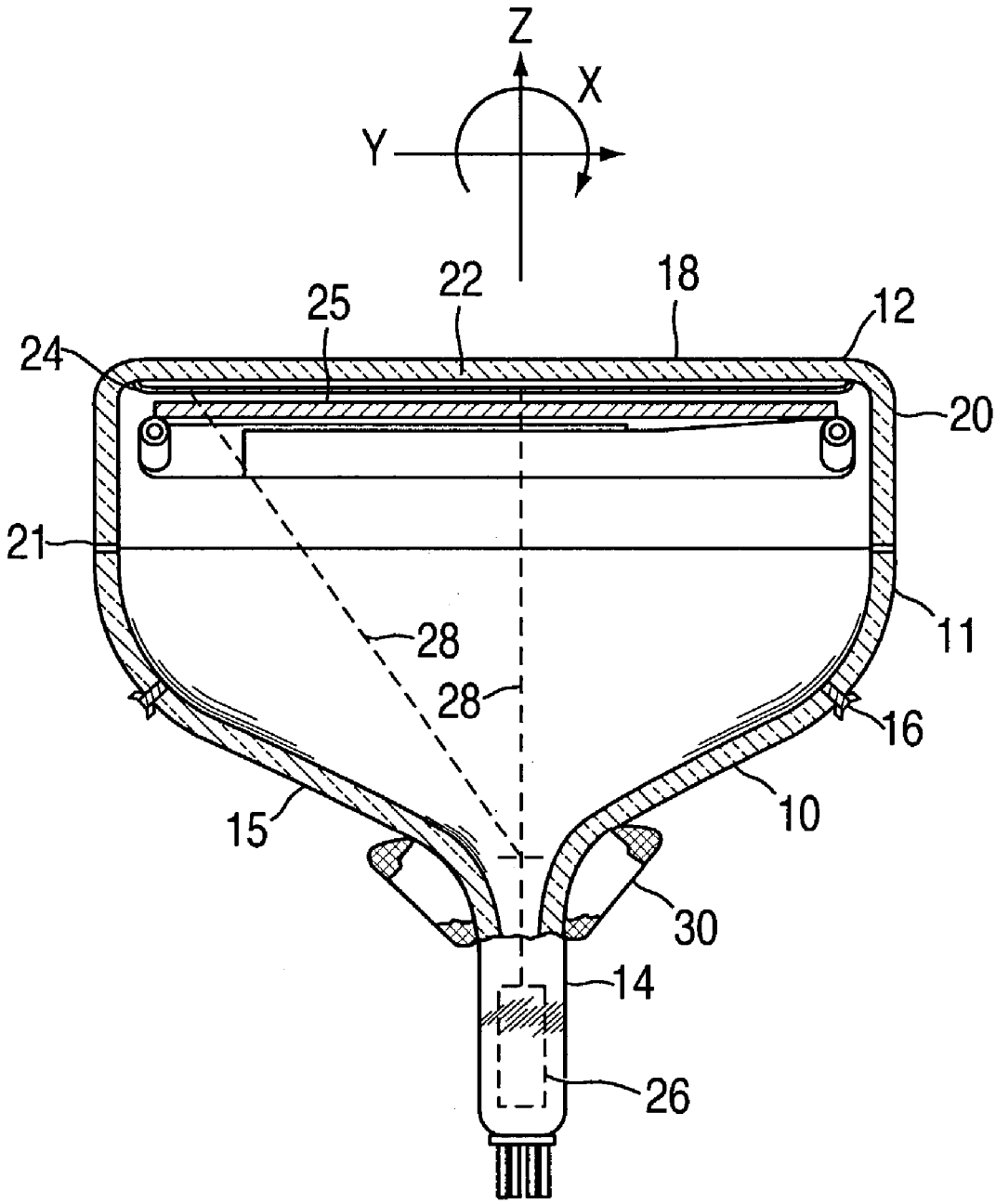
FIG. 1 is a plan view, partially in axial section, of a color cathode ray tube (CRT) made according to embodiments of the present invention.

FIG. 1 shows a conventional color cathode ray tube (CRT) 10 having a glass envelope 11 comprising a faceplate panel 12 and a tubular neck 14 connected by a funnel 15. The funnel has an internal conductive coating (not shown) that is in contact with, and extends from, an anode button 16 to the neck 14.

Figure 2:
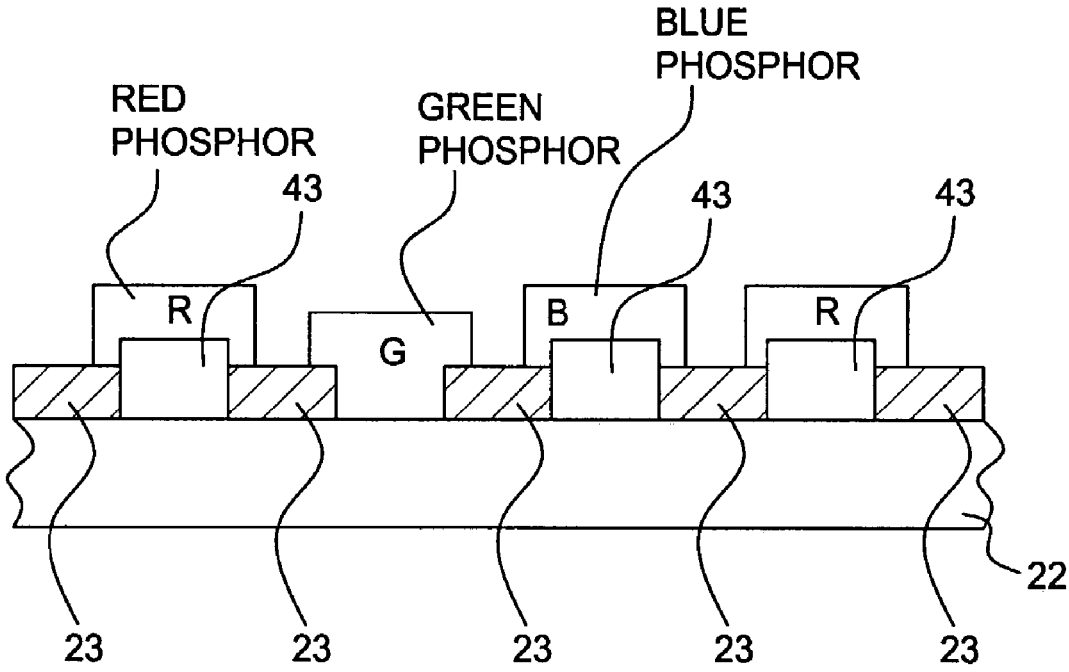
FIG. 2 is a section of the faceplate panel of the CRT of FIG. 1, showing a luminescent screen assembly.

The faceplate panel 12 comprises a viewing surface 18 and a peripheral flange or sidewall 20 that is sealed to the funnel 15 by a glass frit 21. A three-color luminescent phosphor screen 22 is carried on the inner surface of the faceplate panel 12. The screen 22, shown in cross-section in FIG. 2, is a line screen which includes a multiplicity of screen elements comprised of red-emitting, green-emitting and blue-emitting phosphor stripes R, G, and B, respectively, arranged in triads, each triad including a phosphor line of each of the three colors. The R, G and B phosphor stripes extend in a direction that is generally normal to the plane in which the electron beams are generated. At least one of the R, G and B phosphor stripes are formed on color filters 43. The color filters 43 each comprise a pigment that corresponds to the color of the phosphor stripe formed thereon.

A light-absorbing matrix 23, shown in FIG. 2, separates each of the phosphor lines. A thin conductive layer 24 (shown in FIG. 1), preferably of aluminum, overlies the screen 22 and provides means for applying a uniform first anode potential to the screen 22, as well as for reflecting light, emitted from the phosphor elements, through the viewing surface 18. The screen 22 and the overlying aluminum layer 24 comprise a screen assembly.

A multi-aperture color selection electrode, or shadow mask 25 (shown in FIG. 1) is removably mounted, by conventional means, within the faceplate panel 12, in a predetermined spaced relation to the screen 22.

An electron gun 26, shown schematically by the dashed lines in FIG. 1, is centrally mounted within the neck 14, to generate three inline electron beams 28, a center and two side or outer beams, along convergent paths through the shadow mask 25 to the screen 22. The inline direction of the beams 28 is approximately normal to the plane of the paper.

The CRT of FIG. 1 is designed to be used with an external magnetic deflection yoke, such as a yoke 30, shown in the neighborhood of the funnel-to-neck junction. When activated, the yoke 30 subjects the three beams 28 to magnetic fields that cause the beams 28 to scan a horizontal and vertical rectangular raster across the screen 22.

Figure 3:
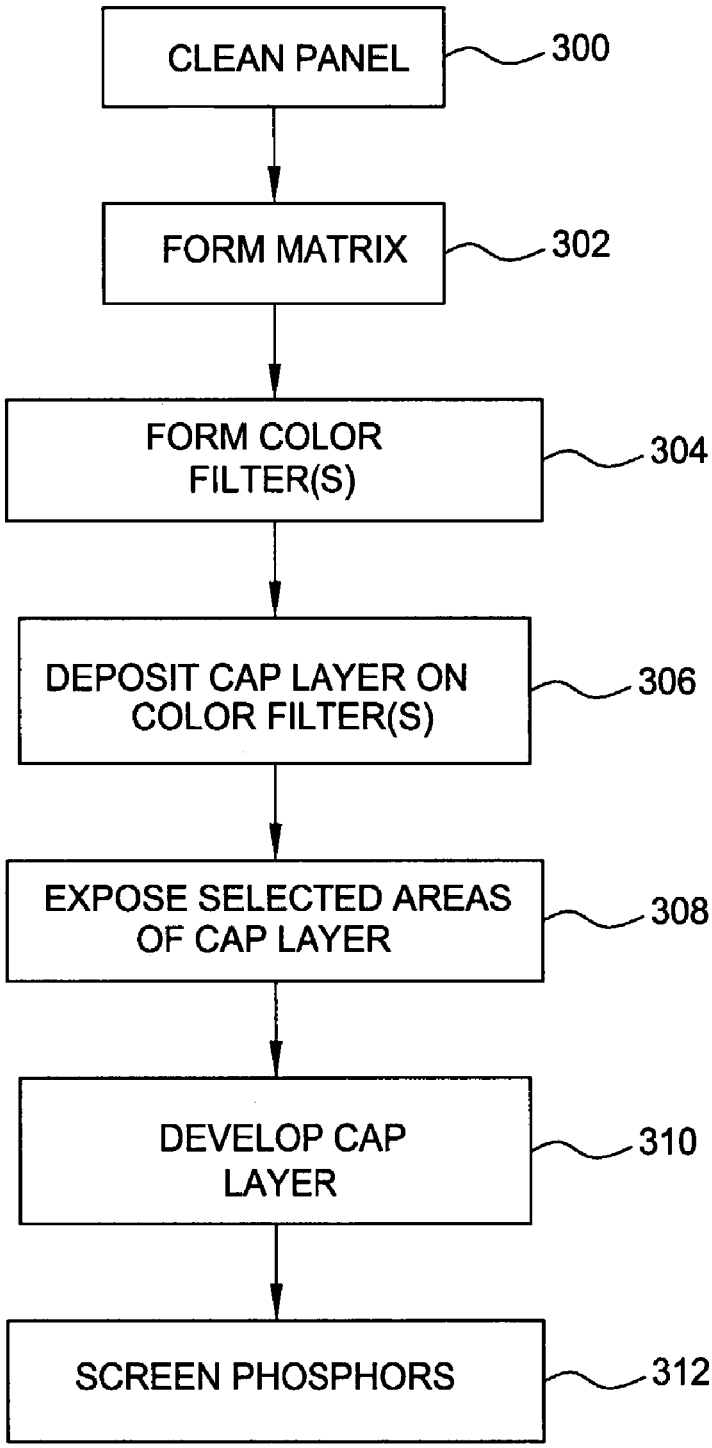
FIG. 3 is a block diagram comprising a flow chart of the manufacturing process for the screen assembly of FIG. 2.

The screen 22 is manufactured according to the process steps represented schematically in FIG. 3. Initially, the faceplate panel 12 is cleaned, as indicated by reference numeral 300, by washing it with a caustic solution, rinsing it in water, etching it with buffered hydrofluoric acid and rinsing it again with water, as is known in the art.

The interior surface of the faceplate panel 12 is then provided with the light-absorbing matrix 23, as indicated by reference numeral 302, preferably using a wet matrix process in a manner described in U.S. Pat. No. 3,558,310 issued Jan. 26, 1971 to Mayaud, U.S. Pat. No. 6,013,400 issued Jan. 11, 2000 to LaPeruta et al., or U.S. Pat. No. 6,037,086 issued to Gorog et al.

Figure 4A:
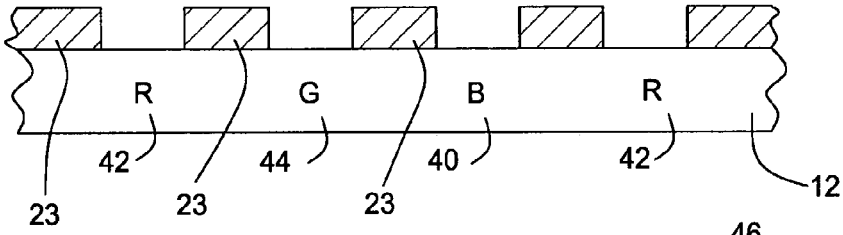
FIGS. 4A–4H depict views of the interior surface of the faceplate panel during formation of the luminescent screen assembly.

The light-absorbing matrix 23 is uniformly provided over the interior viewing surface of faceplate panel 12. For a faceplate panel 12 having a diagonal dimension of about 68 cm (27 inches), the openings or gaps formed between the lines of the light-absorbing matrix 23 can have a width in a range of about 0.075 mm to about 0.25 mm, and the opaque matrix lines can have a width in a range of about 0.075 mm to about 0.30 mm. Referring to FIG. 4A, the light-absorbing matrix 23 defines three sets of fields: a first set of fields 40, a second set of fields 42 and a third set of fields 44.

Figure 4B:
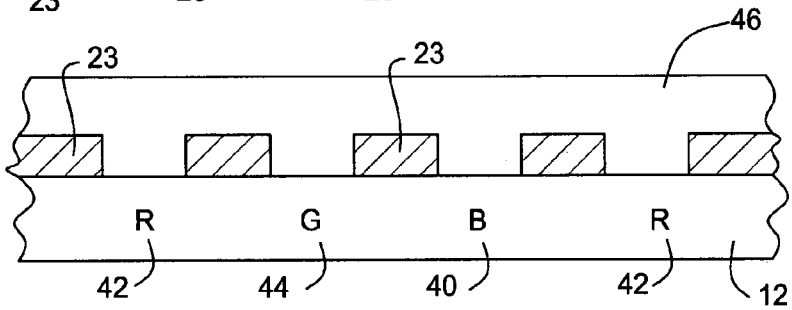

As indicated by reference numeral 304 in FIG. 3, at least one color filter is formed in one or more of the three sets of fields defined by the light-absorbing matrix 23. Referring to FIG. 4B, the at least one color filter may be formed by first depositing a blocking layer 46 on interior surfaces of the faceplate panel 12. The blocking layer 46 may include a photosensitive material. The photosensitive material may comprise, for example, an aqueous solution of sodium dichromate and a polymer such as polyvinyl alcohol. The blocking layer 46 may be formed on the faceplate panel 12 by spin coating the aqueous solution of the polymer and dichromate thereon.

After the blocking layer 46 is deposited on interior surfaces of the faceplate panel 12, portions of the blocking layer 46 may be irradiated using, for example, ultraviolet radiation, through the shadow mask 25 to cross-link the photosensitive material in the second set of fields 42 and the third set of fields 44. Cross-linking the blocking layer 46 in the second set of fields 42 and the third set of fields 44 hardens the photosensitive material in such fields.

Figure 4C:
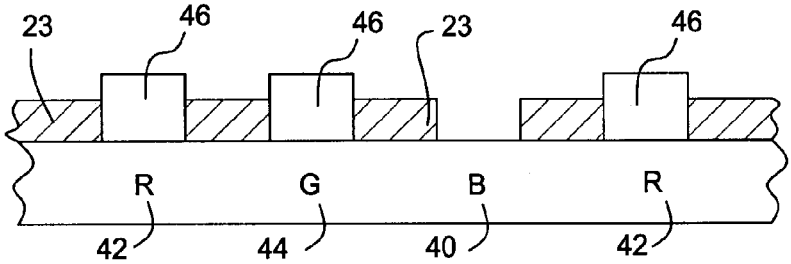

The irradiated blocking layer 46 is then developed. The blocking layer 46 may be developed using, for example, deionized water. After development, the blocking layer 46 is removed over the first set of fields 40, while remaining on the faceplate panel 12 over the second set of fields 42 and the third set of fields 44, as shown in FIG. 4C.

Figure 4D:
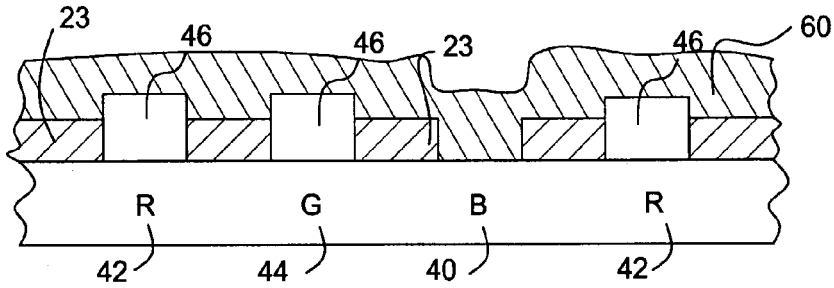

Referring to FIG. 4D, a first color filter layer 60 is applied to the first set of fields 40. The first color filter layer 60 may be applied from a first aqueous pigment suspension that may comprise, for example, a first pigment, one or more surface active agents and at least one non-pigmented oxide particle.

The at least one non-pigmented oxide particles may comprise a material, such as, for example, silica, alumina, or combinations thereof. The at least one non-pigmented oxide particle should have a size less than that of the pigment. Preferably the average size of the at least one non-pigmented oxide particle should be less than about 50 nanometers. The at least one non-pigmented oxide particle is believed to enhance the adhesion of the pigment to the faceplate panel. The at least one non-pigmented oxide particle may be present in a concentration of about 5% to about 10% by weight with respect to the concentration of the pigment.

The first pigment may be, for example, a blue pigment, such as, a daipyroxide blue pigment TM-3490E, commercially available from Daicolor-Pope, Inc. of Paterson, N.J. Another suitable blue pigment may include for example, EX 1041 blue pigment, commercially available from Shepherd Color Co. of Cincinnati, Ohio, among other pigments. Alternatively, the first pigment may be a red pigment. Suitable red pigments may include, for example, diapyroxide red pigment TM-3875, commercially available from Diacolor-Pope, Inc. of Patterson, N.J. Another suitable red pigment may include, for example, R2899 red pigment, commercially available from Elementis Pigments Co. of Fairview Heights, Ill., among other red pigments.

The pigments may be milled using a ball milling process in which the pigment is dispersed along with one or more surfactants in an aqueous suspension. The blue pigments may be ball milled using for example, 1/16" zirconium oxide ($ZrO_2$) balls for at least about 61 hours to about 90 hours. The red pigment may also be ball milled using for example, 1/16" zirconium oxide ($ZrO_2$) balls for at least about 18 hours to about 92 hours.

The one or more surface-active agents may include, for example, organic and polymeric compounds that may optionally adopt an electric charge in aqueous solution. The surface-active agent may comprise, anionic, non-ionic, cationic, and/or amphoteric materials. The surface-active agent may be used for various functions such as improving the homogeneity of the pigment in the aqueous pigment suspension and improved wetting of the faceplate panel 12, among other functions. Examples of suitable surface-active agents include various polymeric dispersants such as, for example, DISPEX N-40V polymeric dispersant (commercially available from Ciba Specialty Chemicals of High Point, N.C.) as well as block copolymer surface active agents such as Pluronic Series (ethoxypropoxy co-polymers) L-62, commercially available from Hampshire Chemical Company of Nashua, N.H., and carboxymethyl cellulose (CMC) commercially available from Yixing Tongda Chemical Co. of China.

The first aqueous pigment suspension may be applied to the faceplate panel 12 by, for example, spin coating in order to form a first color filter layer 60 in the first set of fields 40 of the faceplate panel 12. After spin coating, the first color filter layer 60 may be heated to a temperature in a range from about 55° C. to about 90° C. to provide increased adhesion of the first color filter 60 to the first set of fields 40 of the faceplate panel 12.

Figure 4E:
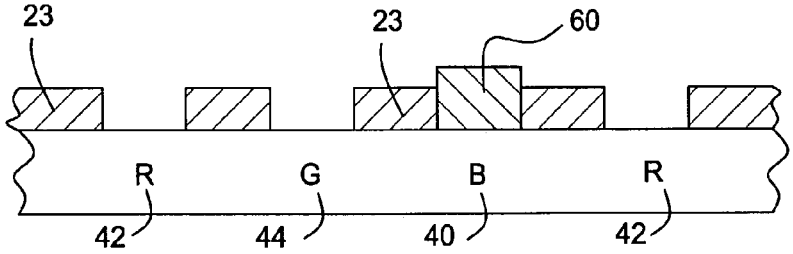

Referring to FIG. 4E, the first color filter layer 60 is developed by applying an oxidizer to the blocking layer 46. Suitable oxidizers may include for example, periodic acid and hydrogen peroxide, among others. Water may then be applied to the faceplate panel 12 in order to remove the blocking layer as well as the first color filter layer 60 over the second set of fields 42 and the third set of fields 44, leaving the first color filter 60 remaining in the first set of fields 40.

After the first color filter layer 60 is developed, the faceplate panel 12 is heated. The faceplate panel 12 may be heated to a temperature of about 85° C. to about 100° C. and then cooled to a temperature of about 26° C. The color filter formation process described above with reference to FIGS. 4B–4E, may then be repeated to form a second or third color filter in the second set of fields 42 or the third set of fields 44, respectively.

Figure 4F:
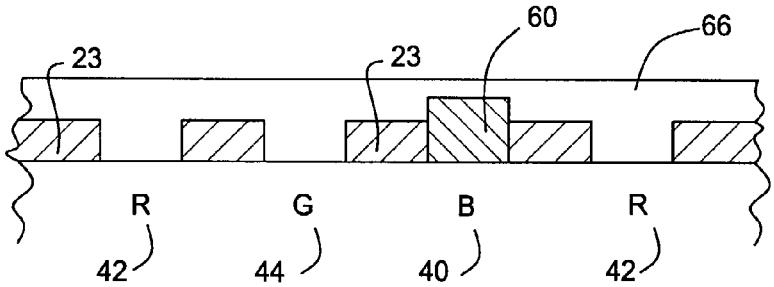

Referring to reference numeral 306 in FIG. 3 as well as FIG. 4F, a cap layer 66 is deposited on the interior surface of the faceplate panel 12 over the first color filter layer 60 in the first set of fields 40. The cap layer 66 may include a photosensitive material. The photosensitive material may comprise, for example, an aqueous solution of a photosensitizer and a polymer. For example, a photosensitizer such as sodium dichromate and a polymer such as polyvinyl alcohol (PVA) may be used. Alternatively, a photosensitizer such as 4,4'-diazidostilbene-2,2'-disulfonic acid sodium salt and a polymer such as polyvinyl pyrrolidone (PVP) may be used. Other photosensitizer/polymer combinations are also contemplated.

The cap layer 66 may be formed on the faceplate panel 12 by spin coating the aqueous solution of the polymer and dichromate thereon. The cap layer should preferably have a thickness within a range of about 0.5 μm (micrometers) to about 2.0 μm.

Referring to reference numeral 308 in FIG. 3, the cap layer 66 is irradiated using, for example, ultraviolet radiation, through the shadow mask 25 to cross-link the photosensitive material in the first set of fields 40 over the first color filter layer 60. Cross-linking the cap layer 66 in the first set of fields 40 hardens the photosensitive material in such fields forming a protective coating over the first color filter layer 60. Formation of the cap layer 66 over the first color filter layer 60 improves the adherence of the subsequently deposited phosphor layer to the color filter layer so as to minimize void formation therein. Voids resulting from adhesion failure of portions of the phosphor layer may result in lower light output and lower contrast performance for the luminescent screen.

Figure 4G:
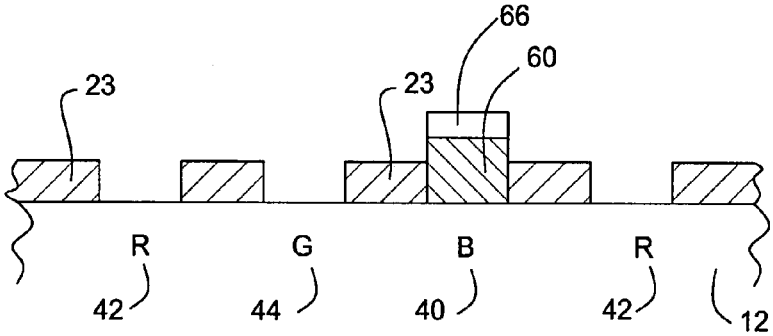

The irradiated cap layer 66 is then developed as indicated by reference numeral 310 in FIG. 3 as well as FIG. 4G. The cap layer 66 may be developed using, for example, deionized water. After development, the cap layer 66 is removed over the second set of fields 42 and the third set of fields 44, while remaining on the faceplate panel 12 over the first color filter layer 60 in the first set of fields 40. The cap layer formation process described above as indicated by reference numerals 306 through 310 and FIGS. 4F–4G, may optionally be repeated to form cap layers over second or third color filters in the second set of fields 42 or the third set of fields 44, if these fields were to contain second and third color filter layers.

Figure 4H:
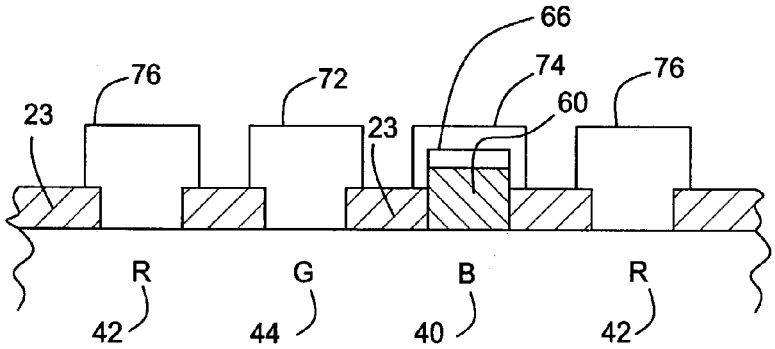

The faceplate panel 12 is then screened with non-pigmented green phosphors 72, non-pigmented blue phosphors 74 and non-pigmented red phosphors 76, as indicated by reference numeral 312 in FIG. 3 as well as FIG. 4H, preferably, using a screening process in a manner known in the art.

Figure 5A:
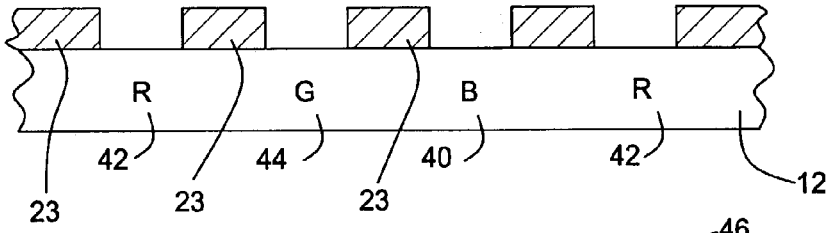
FIGS. 5A–5L depict views of the interior surface of the faceplate panel during formation of an exemplary luminescent screen assembly.

In an exemplary luminescent screen assembly fabrication process, a 20 inch faceplate panel having matrix lines formed thereon was used as shown in FIG. 5A.

Figure 5B:
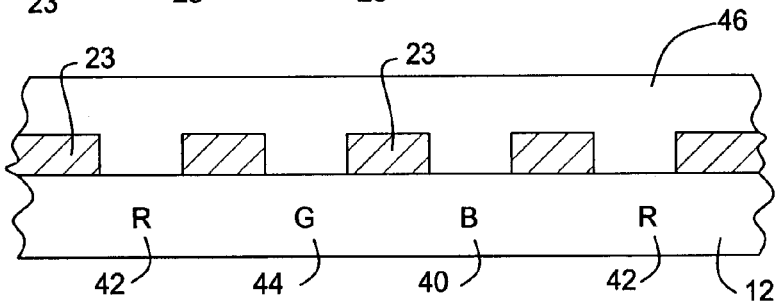

In such an example, a 150 ml solution of 275 grams of deionized water, 160 grams of 10% polyvinyl alcohol and 21 grams of 10% sodium dichromate diluted to a viscosity of 35 cp (centipoise) was applied to the faceplate panel. The faceplate panel was spun at 8 rpm for 22 seconds while the 150 ml solution was applied thereto and then at 170 rpm for 30 seconds, heated to 51° C. and cooled to 35° C. to form a photosensitive first blocking layer thereon as shown in FIG. 5B.

Figure 5C:
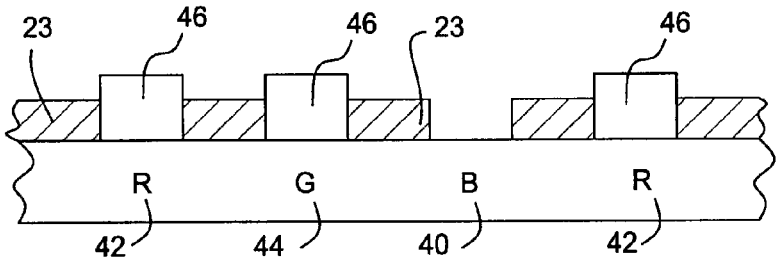

The coated faceplate panel was irradiated using an ultraviolet source (400 watts per square meter) for 40 seconds through a corresponding shadow mask, to cross-link the photosensitive material in the red and green fields. The irradiated faceplate panel was developed using 43° C. water at 20 psi for 20 seconds and then dried. This resulted in the formation of a first blocking layer 46 in the red fields and the green fields, with the removal of the first blocking layer in the blue fields as shown in FIG. 5C.

One hundred-ten grams of a blue pigment concentrate, comprising 50 grams of TM-3490E Diapyroxide blue pigment (commercially available from Diacolor-Pope, Inc. of Paterson, N.J.) in 190 grams of water, was mixed with 2.5 grams of 5% Pluronic Series (ethoxypropoxy co-polymer) L-62 (commercially available from BASF Corp. of Germany) in 50:50 methanol:water, 4 grams of a colloidal silica, SNOWTEX XS (20% active silica, available from Nissan Chemical Industries of Tokyo, Japan), and enough deionized water to yield an aqueous blue pigment suspension comprising about 13 weight % pigment.

Figure 5D:
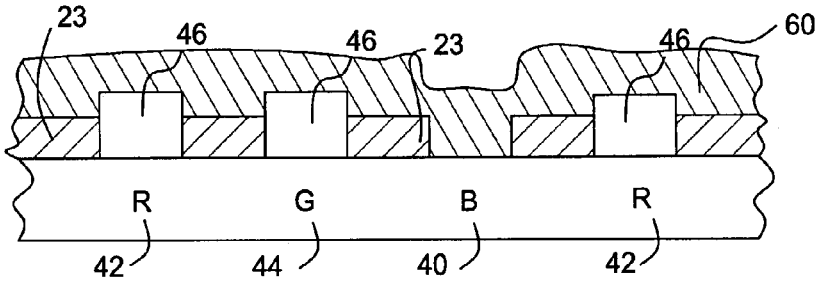

The aqueous blue pigment suspension was then applied to the faceplate panel at room temperature. The faceplate panel was spun at 8 rpm for 52 seconds while the blue pigment suspension was applied thereto and then at 100 rpm for 20 seconds, heated to 65° C., and cooled to 35° C. to form a blue color filter layer 60 on the faceplate panel as shown in FIG. 5D.

Figure 5E:
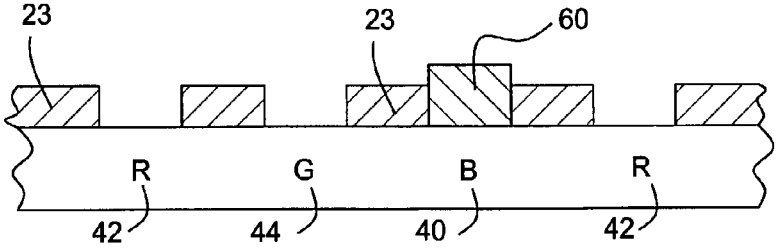

The faceplate panel with the blue color filter layer thereon was heated to a temperature of 55° C. The blue color filter layer was developed by applying a 0.03% periodic acid solution to the faceplate panel for 90 seconds. Thereafter, the faceplate panel was sprayed with 43° C. water at 42 psi for 15 seconds. This development step removed the first blocking layer 46 with the blue pigment layer 60 thereon from both the red fields and the green fields, leaving a blue color filter in the blue fields as shown in FIG. 5E.

Figure 5F:
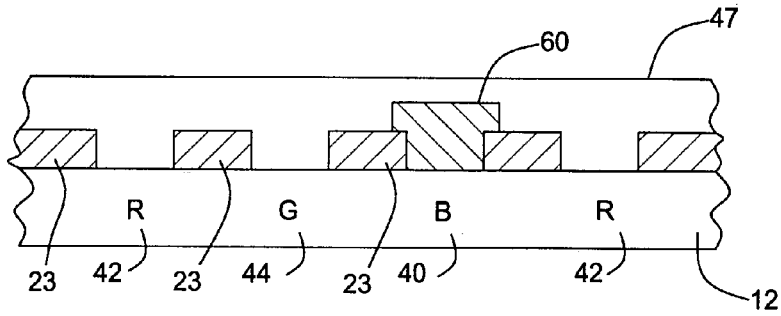
Figure 5G:
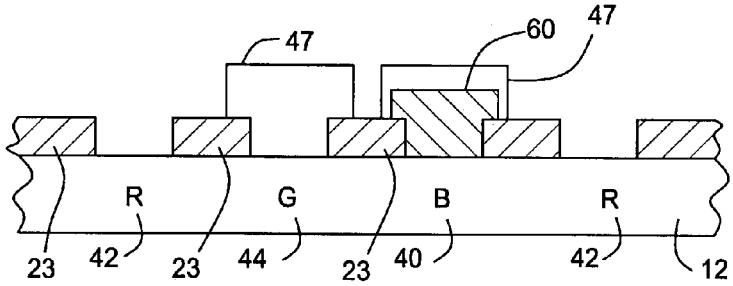

A second blocking layer 47 comprising a photosensitive material was formed on the faceplate panel as indicated above and as shown in FIG. 5F. The coated faceplate panel was irradiated using an ultraviolet source (400 watts per square meter) through a corresponding shadow mask, to cross-link the photosensitive material in the blue fields and the green fields. The blue fields were irradiated for 60 seconds and the green fields were irradiated for 40 seconds. The irradiated faceplate panel was developed using 43° C. water at 20 psi for 20 seconds and then dried. This resulted in the formation of a second blocking layer in the blue fields and the green fields, with the removal of the blocking layer in the red fields as shown in FIG. 5G.

One hundred-ten grams of a red pigment concentrate, comprising 50 grams of TM-3875 Diapyroxide red pigment (commercially available from Diacolor-Pope, Inc. of Paterson, N.J.) in 190 grams of water, was mixed with 5 grams of 5% Pluronic Series (ethoxypropoxy co-polymer) L-62 (commercially available from BASF Corp. of Germany) in 50:50 methanol:water, and enough deionized water to yield an aqueous red pigment suspension comprising about 5 weight % pigment.

The aqueous red pigment suspension was then applied to the faceplate panel at room temperature. The faceplate panel was spun at 8 rpm for 52 seconds while the red pigment suspension was applied thereto and then at 100 rpm for 20 seconds, heated to 65° C., and cooled to 35° C. to form a red color filter layer 61 on the faceplate panel.

Figure 5H:
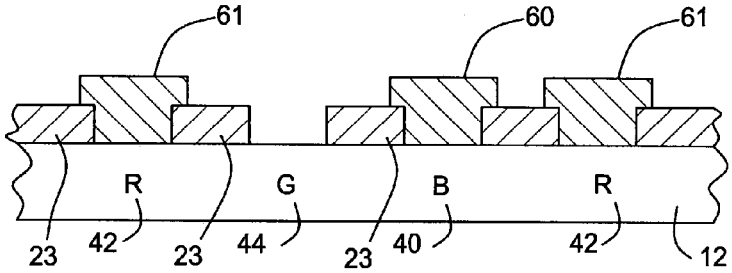
Figure 5I:
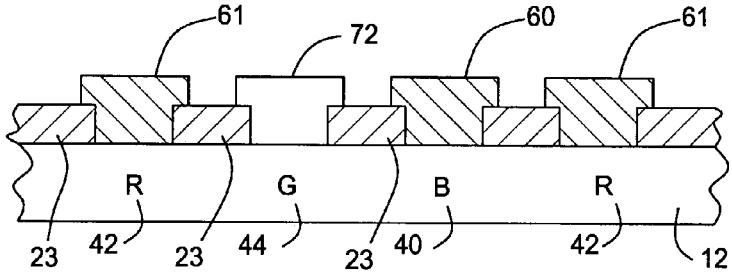

The faceplate panel with the red color filter layer 61 thereon was heated to a temperature of 55° C. The blue color filter layer was developed by applying a 0.03% periodic acid solution to the faceplate panel for 90 seconds. Thereafter, the faceplate panel was sprayed with 43° C. water at 42 psi for 15 seconds. This development step removed the second blocking layer with the red pigment layer 61 thereon from both the blue fields and the green fields, leaving a red color filter in the red fields as shown in FIG. 5H.

One hundred twenty-five milliliters of a non-pigmented green slurry, comprising 150 grams of 10% polyvinyl alcohol, 14 grams of 10% sodium dichromate, 5 grams of 5%

Pluronic Series (ethoxypropoxy co-polymer) L-92 (commercially available from BASF Corp. of Germany), 8.5 grams tetra(ethylene glycol) (TEG), 0.4 grams of 25% TAMOL (polycarbonate salt) surfactant (commercially available from Rhom & Haas Co., Philadelphia, Pa.), 1.3 grams of 30% TWEEN-20 (polysorbate) (commercially available from Atlas Chemical Co., Chicago, Ill.), and 200 grams of GR525-TCG-2 phosphor (zinc sulfide silver, aluminum, gold doped phosphor) (commercially available from USR Optonix Inc., Hackettstown, N.J.), in 240 grams of deionized water, was then applied to the faceplate panel. The faceplate panel was spun at 8 rpm for 67 seconds while the pigmented green slurry was applied thereto and then at 170 rpm for 25 seconds, heated to 51° C., and cooled to 35° C. to form a green phosphor layer on the faceplate panel.

The coated faceplate panel was irradiated using an ultraviolet source (400 watts per square meter) through a corresponding shadow mask, to cross-link the photosensitive material in the green fields. The green fields were irradiated for 12 seconds. The irradiated faceplate panel was developed using 43° C. water at 28 psi for 20 seconds and then dried. This resulted in the formation of a nonpigmented green phosphor layer 72 in the green fields, with the removal of the nonpigmented green phosphor layer 72 in the red fields and the blue fields as shown in FIG. 51.

A one hundred thirty milliliter solution comprising 150 grams of 10% polyvinyl alcohol, 11.5 grams of 10% sodium dichromate, 5 grams of 5% Pluronic Series (ethoxypropoxy co-polymer) L-92 (commercially available from BASF Corp. of Germany), 4.5 grams tetra(ethylene glycol) (TEG), 0.6 grams of 25% TAMOL (polycarbonate salt) surfactant (commercially available from Rhom & Haas Co., Philadelphia, Pa.), 1.3 grams of 30% TWEEN-20 (polysorbate) (commercially available from Atlas Chemical Co., Chicago, Ill.) and 240 grams of deionized water diluted to a viscosity of 15 cp, was then applied to the faceplate panel. The faceplate panel was spun at 8 rpm for 67 seconds while the solution was applied thereto and then at 170 rpm for 30 seconds, heated to 52° C., and cooled to 35° C. to form a cap layer 66 on the faceplate panel.

Figure 5J:
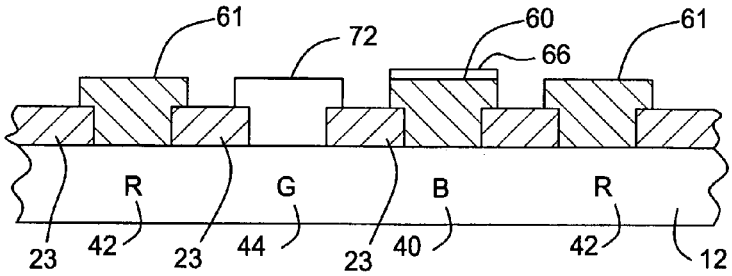

The coated faceplate panel was irradiated using an ultraviolet source (400 watts per square meter) through a corresponding shadow mask, to cross-link the cap layer in the blue fields. The blue fields were irradiated for 50 seconds. The irradiated faceplate panel was developed using 43° C. water at 20 psi for 20 seconds and then dried. This resulted in the formation of a cap layer 66 on the blue filter layer in the blue fields, with the removal of the cap layer 66 in the red fields and the green fields, as shown in FIG. 5J.

One hundred twenty-five milliliters of a non-pigmented blue slurry, comprising 150 grams of 10% polyvinyl alcohol, 11.5 grams of 10% sodium dichromate, 5 grams of 5% Pluronic Series (ethoxypropoxy co-polymer) L-92 (commercially available from BASF Corp. of Germany), 4.5 grams tetra(ethylene glycol) (TEG), 0.6 grams of 25% TAMOL (polycarbonate salt) surfactant (commercially available from Rhom & Haas Co., Philadelphia, Pa.), 1.3 grams of 30% TWEEN-20 (polysorbate) (commercially available from Atlas Chemical Co., Chicago, Ill.), and 200 grams BL361 phosphor (zinc sulfide silver doped phosphor) (commercially available from USR Optonix Inc., Hackettstown, N.J.), in 240 grams of deionized water, was then applied to the faceplate panel. The faceplate panel was spun at 8 rpm for 67 seconds while the non-pigmented blue slurry was applied thereto and then at 170 rpm for 30 seconds, heated to 51° C., and cooled to 35° C. to form a non-pigmented blue phosphor layer on the faceplate panel.

Figure 5K:
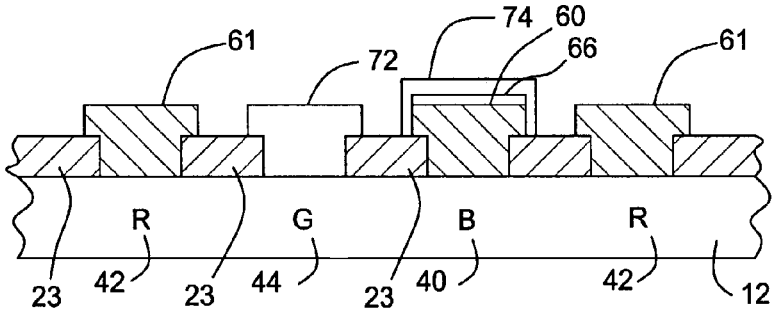

The coated faceplate panel was irradiated using an ultraviolet source (400 watts per square meter) through a corresponding shadow mask, to cross-link the photosensitive material in the blue fields. The blue fields were irradiated for 25 seconds. The irradiated faceplate panel was developed using 43° C. water at 20 psi for 20 seconds and then dried. This resulted in the formation of a non-pigmented blue phosphor layer 74 on the cap layer 66 in the blue fields, with the removal of the non-pigmented blue phosphor layer in the red fields and the green fields as shown in FIG. 5K.

One hundred twenty-five milliliters of a non-pigmented red slurry, comprising 160 grams of 10% polyvinyl alcohol, 21 grams of 10% sodium dichromate, 5 grams of 5% Pluronic Series (ethoxypropoxy co-polymer) L-92 (commercially available from BASF Corp. of Germany), 3 grams tetra(ethylene glycol) (TEG), 6 grams of 25% TAMOL (polycarbonate salt) surfactant (commercially available from Rhom & Haas Co., Philadelphia, Pa.), 1.3 grams of 30% TWEEN-20 (polysorbate) (commercially available from Atlas Chemical Co., Chicago, Ill.), and 200 grams RE555 phosphor (yttrium oxysulfide europium doped phosphor) (commercially available from USR Optonix, Hackettstown, N.J.), in 275 grams of deionized water, was then applied to the faceplate panel. The faceplate panel was spun at 8 rpm for 67 seconds while the non-pigmented red slurry was applied thereto and then at 170 rpm for 26 seconds, heated to 51° C., and cooled to 35° C. to form a non-pigmented red phosphor layer 76 on the faceplate panel.

Figure 5L:
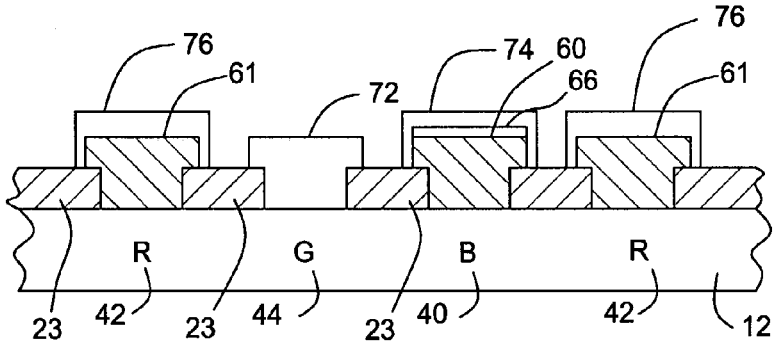

The coated faceplate panel was irradiated using an ultraviolet source (400 watts per square meter) through a corresponding shadow mask, to cross-link the photosensitive material in the red fields. The red fields were irradiated for 15 seconds. The irradiated faceplate panel was developed using 43° C. water at 28 psi for 20 seconds and then dried. This resulted in the formation of a non-pigmented red phosphor layer 76 on the red filter layer 61 in the red fields, with the removal of the non-pigmented red phosphor layer in the blue fields and the green fields as shown in FIG. 5L.

What is claimed is:

1. A method of manufacturing a luminescent screen assembly for a color cathode-ray tube (CRT), comprising:

providing a faceplate panel having a patterned light absorbing matrix thereon defining a plurality of sets of fields;

applying a pigment layer to one of the plurality of sets of fields;

forming a cap layer on the pigment layer; and forming a phosphor layer on the cap layer, wherein the cap layer is formed from an aqueous solution of a photosensitizer and a polymer, and wherein the polymer comprises one or more materials selected from the group consisting of polyvinyl alcohol (PVA) and polyvinyl pyrrolidone (PVP), wherein the cap layer has a thickness within the range of about 0.5 μm (micrometers) to about 2.0 μm (micrometers).

2. The method of claim 1 wherein the pigment layer is selected from the group consisting of blue pigment, red pigment and green pigment.

3. A method of manufacturing a luminescent screen assembly for a color cathode-ray tube (CRT), comprising:

providing a faceplate panel having a patterned light absorbing matrix thereon defining a plurality of sets of fields;

forming a blue pigment layer in one of the plurality of sets of fields;

forming a cap layer on the blue pigment layer; and forming a phosphor layer on the cap layer, wherein the cap layer is formed from an aqueous solution of a photosensitizer and a polymer, and wherein the polymer comprises one or more materials selected from the group consisting of polyvinyl alcohol (PVA) and polyvinyl pyrrolidone (PVP), wherein the cap layer has a thickness within the range of about 0.5 μm (micrometers) to about 2.0 μm (micrometers).

4. A luminescent screen assembly for a color cathode-ray tube (CRT), comprising:

a faceplate panel having a patterned light absorbing matrix thereon defining a plurality of sets of fields;

a pigment layer formed in one of the plurality of sets of fields;

a cap layer formed on the pigment layer; and a phosphor layer formed on the cap layer, wherein the cap layer is formed from an aqueous solution of a photosensitizer and a polymer, and wherein the polymer comprises one or more materials selected from the group consisting of polyvinyl alcohol (PVA) and polyvinyl pyrrolidone (PVP), wherein the cap layer has a thickness within the range of about 0.5 μm (micrometers) to about 2.0 μm (micrometers).

5. The luminescent screen assembly of claim 4 wherein the pigment layer is selected from the group consisting of blue pigment, red pigment and green pigment.

6. A method of manufacturing a luminescent screen assembly for a color cathode-ray tube (CRT), comprising:

providing a faceplate panel having a patterned light absorbing matrix thereon defining a plurality of sets of fields;

applying a pigment layer to one of the plurality of sets of fields;

applying a cap layer on the pigment layer, wherein the cap layer is formed from an aqueous solution of a photosensitizer and a polymer;

irradiating the cap layer to cross-link portions thereof, thereby forming cross-linked cap layer portions;

developing the can layer to remove parts of the cap layer not cross-linked; and forming a phosphor layer on the cross-linked cap layer portions.

7. The method of claim 6 wherein the pigment layer is selected from the group consisting of blue pigment, red pigment and green pigment.

8. The method of claim 6 wherein the polymer comprises one or more materials selected from the group consisting of polyvinyl alcohol (PVA) and polyvinyl pyrrolidone (PVP).

9. A method of manufacturing a luminescent screen assembly for a color cathode-ray tube (CRT), comprising:

providing a faceplate panel having a patterned light absorbing matrix thereon define a plurality of sets of fields;

applying a pigment layer to one of the plurality of sets of fields;

applying a cap layer on the pigment layer, wherein the cap layer is formed from an aqueous solution of a photosensitizer and a polymer; and forming a phosphor layer on the cap layer, wherein the cap layer has a thickness within a range of about 0.5 μm (micrometers) to about 2.0 μm.

10. A method of manufacturing a luminescent screen assembly for a color cathode-ray tube (CRT), comprising:

providing a faceplate panel having a patterned light absorbing matrix thereon defining a plurality of sets of fields;

forming a blue pigment layer in one of the plurality of sets of fields;

applying a cap layer on the blue pigment layer wherein the cap layer is formed from an aqueous solution of a photosensitizer and a polymer;

irradiating the cap layer to cross-link portions thereof, thereby forming cross-linked cap layer portions;

developing the cap layer to remove parts of the cap layer not cross-linked; and forming a phosphor layer on the cross-linked cap layer portions.

11. The method of claim 10 wherein the polymer comprises one or more materials selected from the group consisting of polyvinyl alcohol (PVA) and polyvinyl pyrrolidone (PVP).

12. A method of manufacturing a luminescent screen assembly for a color cathode-ray tube (CRT) comprising:

providing a faceplate panel having a patterned light absorbing matrix thereon defining a plurality of sets of fields;

forming a blue pigment layer in one of the plurality of sets of fields;

applying a cap layer on the blue pigment layer wherein the cap layer is formed from an aqueous solution of a photosensitizer and a polymer; and forming a phosphor layer on the cap layer, wherein the cap layer has a thickness within a range of about 0.5 μm (micrometers) to about 2.0 μm (micrometers).

13. A luminescent screen assembly for a color cathode-ray tube (CRT), comprising:

a faceplate panel having a patterned light absorbing matrix thereon defining a plurality of sets of fields;

a pigment layer formed in one of the plurality of sets of fields;

cross-linked cap layer portions formed on the pigment layer, said cross-linked cap layer portions being formed from an application, irradiation, and development of a cap layer from aqueous solution of a photosensitizer and a polymer; and a phosphor layer formed on the cross-linked cap layer portions.

14. The luminescent screen assembly of claim 13 wherein the pigment layer is selected from the group consisting of blue pigment, red pigment and green pigment.

15. The luminescent screen assembly of claim 13 wherein the polymer comprises one or more materials selected from the group consisting of polyvinyl alcohol (PVA) and polyvinyl pyrrolidone (PVP).

16. A luminescent screen assembly for a color cathode-ray tube (CRT), comprising:

a faceplate panel having a patterned light absorbing matrix thereon defining a plurality of sets of fields;

a pigment layer formed in one of the plurality of sets of fields;

a cap layer applied on the pigment layer from an aqueous solution of a photosensitizer and a polymer; and a phosphor layer formed an the cap layer, wherein the cap layer has a thickness within a range of 0.5 μm (micrometers) to about 2.0 μm.

* * * * *